United States Patent [19]

Specktor

[11] 4,138,877

[45] Feb. 13, 1979

[54] ACCESSORIES FOR AN APPARATUS FOR REPAIRING AND STRAIGHTENING

[76] Inventor: Gerald A. Specktor, 409 Cleveland Ave., South, St. Paul, Minn. 55105

[21] Appl. No.: 722,825

[22] Filed: Sep. 13, 1976

Related U.S. Application Data

[63] Continuation of Ser. No. 550,378, Feb. 18, 1975, abandoned.

[51] Int. Cl.[2] ..... B21D 1/14; B21D 11/22

[52] U.S. Cl. ..... 72/461; 72/705; 105/476; 105/485; 105/486

[58] Field of Search ..... 72/457, 461, 705; 105/368 T, 473, 463, 484, 485, 476, 486; 24/201 A; 403/18; 248/500, 503

[56] References Cited

U.S. PATENT DOCUMENTS

| | | | |
|---|---|---|---|
| 1,676,263 | 7/1928 | Hawkins | 72/705 X |
| 2,451,307 | 10/1948 | South | 72/705 X |
| 3,108,629 | 10/1963 | Jenkins | 72/705 X |
| 3,131,747 | 5/1964 | Junkins | 72/705 X |
| 3,252,681 | 5/1966 | Watts | 105/485 |
| 3,269,169 | 8/1966 | Latuff et al. | 72/705 X |
| 3,276,237 | 10/1966 | Transue | 72/705 X |
| 3,518,867 | 7/1970 | Rouis | 72/705 X |
| 3,631,705 | 1/1972 | McCaffrey | 72/705 X |
| 3,689,030 | 9/1972 | Backus | 72/705 X |
| 3,888,100 | 6/1975 | Chisum | 72/705 X |

FOREIGN PATENT DOCUMENTS 2227849 12/1973 Fed. Rep. of Germany ..... 72/705

*Primary Examiner*—Carl E. Hall
*Assistant Examiner*—D. M. Gurley
*Attorney, Agent, or Firm*—Wicks & Nemer

[57] ABSTRACT

Acccessories are disclosed, in their preferred forms, for use in conjunction with an apparatus for repairing and straightening vehicles having a support surface, for supporting vehicles thereon, including an array of regularly shaped apertures which extend vertically therethrough. A unibody clamp is disclosed including adjustable jaws for removably gripping the pinch weld of a unibody frame. Abutment wings are further provided on the clamp for abutting with a stop member which accepts, substantially in line, the counterforce from the clamp. A first connector member is further provided on the clamp for attaching a chain held in an elevated position by an elevated chain apparatus. First connector member further allows the use of a down pull member including a chain directed to the clamp by a rotatably mounted pulley. A second connector member is further provided on the clamp allowing the exertion of a force perpendicular to the pinch weld of the unibody frame. The stop member, elevated chain apparatus, and down pull member are removably attached to the support surface by an attachment member which extends into a selected support surface aperture and allows self-alignment thereof in the support surface.

84 Claims, 10 Drawing Figures

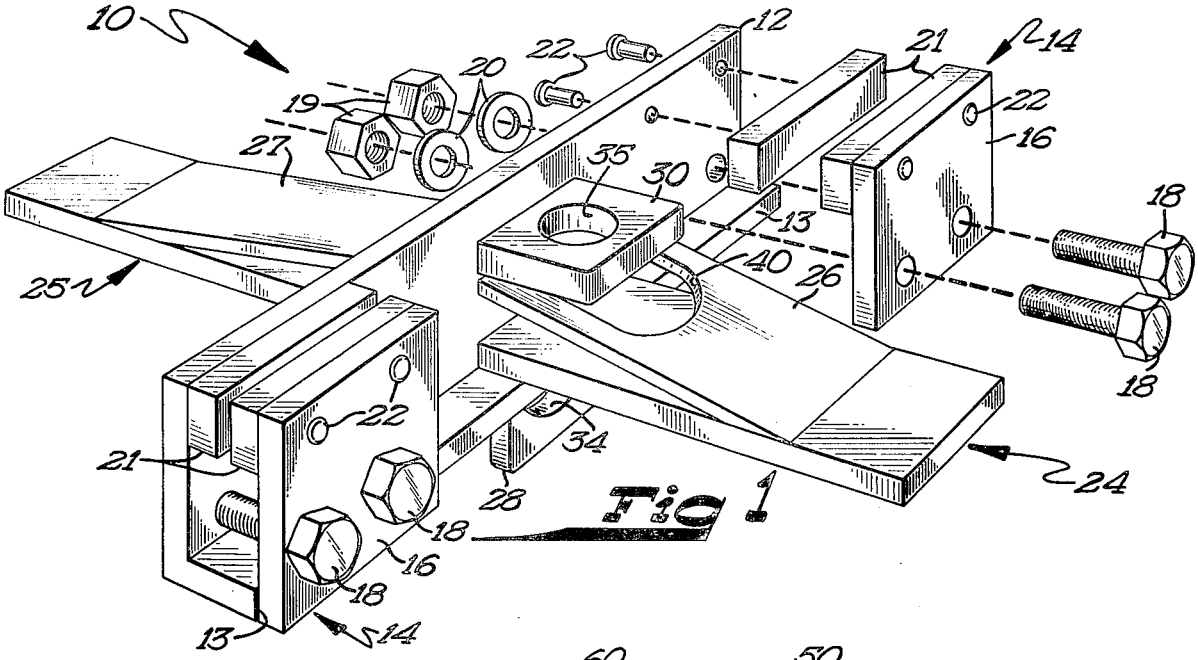
Fig 1
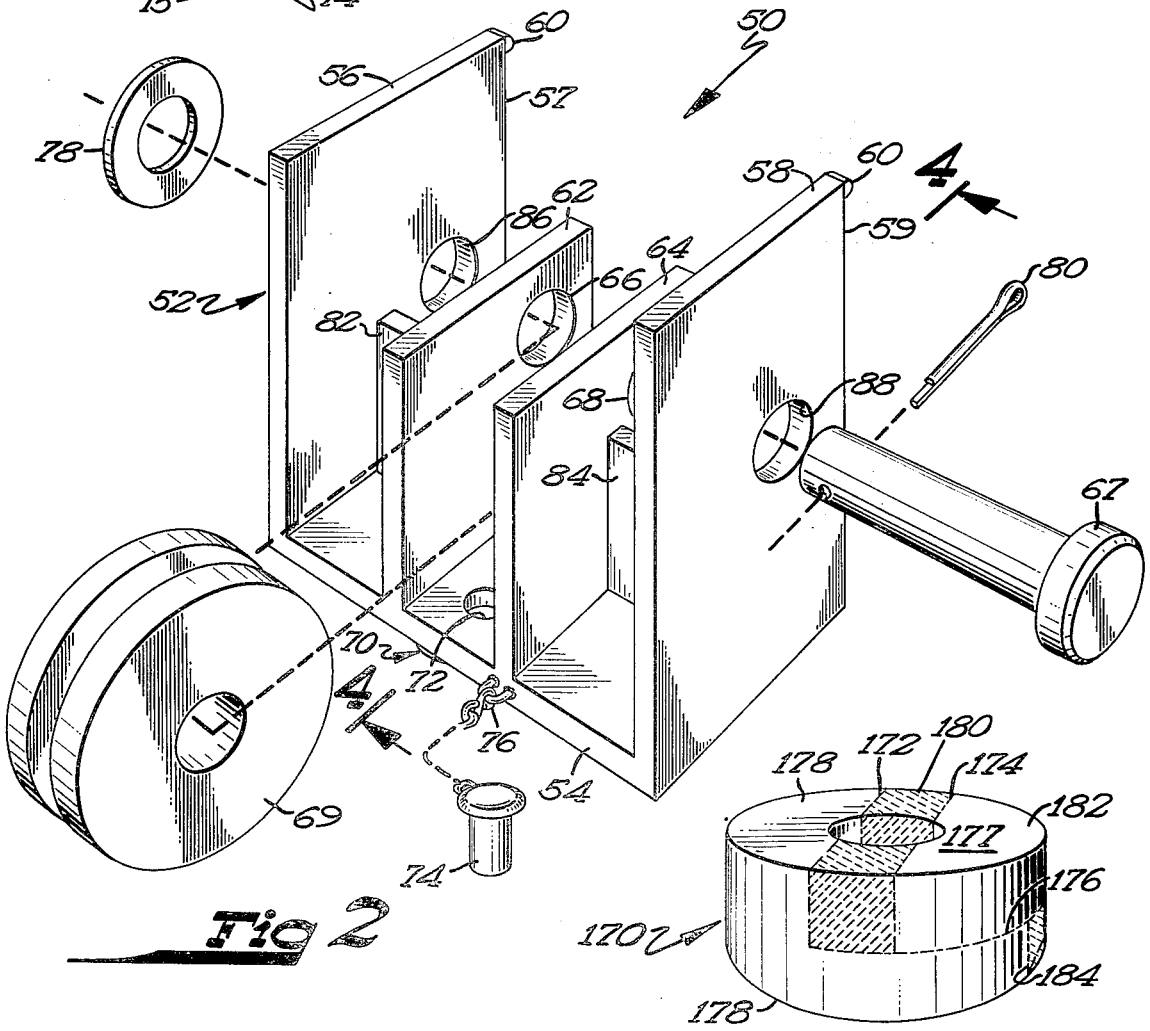
Fig 2
Fig 10

ACCESSORIES FOR AN APPARATUS FOR REPAIRING AND STRAIGHTENING

CROSS REFERENCE

This is a continuation of application Ser. No. 550,378 filed Feb. 18, 1975, by the same inventor, now abandoned.

BACKGROUND

The present invention relates generally to accessories, and more particularly, to accessories for an apparatus for repairing and straightening vehicles.

With the increasing sophistication of apparatus for repairing and straightening, faster repairing and straightening of damaged vehicles has been attained without large expenditures of time, labor, and energy. There is also an increasing need for accessories for use in such apparatus for repairing and straightening to further increase their ability to repair vehicles having various types of damage and to further increase their efficiency to thus further reduce the time, labor, and effort required to repair and straighten vehicles. Also, such accessories should be easy to operate without the need for other type of apparatus, such as support blocks.

Still further, such apparatus should be light in weight, and of small size thus allowing easy use thereof without the expenditures of large amounts of energy.

A special need has arisen for accessories for use in repairing unibody type vehicles. Previous apparatus used in anchoring unibody type vehicles had serious deficiencies in the ability to accept the counterforce conveyed from the vehicle substantially in line. Therefore, it was necessary to align the vehicle exactly in a position allowing the counterforce to be conveyed substantially in line. Thus, it was necessary to move the vehicle to an exact position, possibly several times, thus requiring large expenditures of time and effort. Also, if the vehicles were not substantially in line with the accessories, previously known accessories could damage the vehicle when the repair force was exerted thereto. Further, such previously known accessories also suffered serious deficiencies in the ability for their use in unibody vehicles having bent pinch welds.

SUMMARY

The present invention solves these and other problems in the accessories for use in an apparatus for repairing and straightening by providing, in the preferred embodiment, an attachment member for use with a support surface having an array of regularly shaped apertures passing therethrough. The attachment member attaches the accessory members to the support surface and allows self-alignment of the accessory members with respect to the vehicle.

A first preferred form of an accessory according to the teachings of the present invention is a stop member which abuts with abutment wings formed on an elongated clamp which removably captures the pinch weld of a unibody frame. The stop member is thus able to accept, substantially in line, the counterforce exerted by the clamp.

A second preferred form of an accessory according to the teachings of the present invention is a member which allows the attachment of a chain at an elevated position. Therefore, the chain may lie in a substantially horizontal manner to accept, substantially in line, the counterforce exerted by the vehicle.

A third preferred embodiment of an accessory according to the teachings of the present invention is a down pull member allowing a chain to be directed in a generally vertical manner to the vehicle.

It is a primary object of the present invention to provide novel accessories for use in an apparatus for repairing and straightening.

It is further an object of the present invention to provide such accessories for accepting the counterforce from a unibody clamp member in a substantially horizontal manner.

It is further an object of the present invention to provide such accessories allowing self-alignment.

It is further an object of the present invention to provide such accessories allowing the accessory to be substantially in line with the counterforce exerted by the vehicle.

It is further an object of the present invention to provide such accessories allowing the attachment of a chain at an elevated position.

It is further an object of the present invention to provide such accessories allowing a repair force to be exerted on the vehicle in a substantially vertical manner.

It is further an object of the present invention to provide such accessories which maximizes the materials used.

It is further an object of the present invention to provide such accessories which are easy to use in conjunction with an apparatus for repairing and straightening.

It is further an object of the present invention to provide such accessories which allow a repair force to be exerted perpendicular to the pinch weld of a unibody frame.

These and further objects and advantages of the present invention will become clearer in light of the following detailed description of an illustrative embodiment of this invention described in connection with the drawings.

DESCRIPTION OF THE DRAWINGS

The illustrative embodiments may best be described by reference to the accompanying drawings where:

FIG. 1 is an exploded perspective view of a clamp member utilizing the teachings of the present invention.

FIG. 2 is an exploded perspective view of a member which can be utilized with the apparatus of FIG. 1.

FIG. 10 is a perspective view showing the method of manufacture of the apparatus as best seen in FIGS. 4 and 5.

Figure 8:
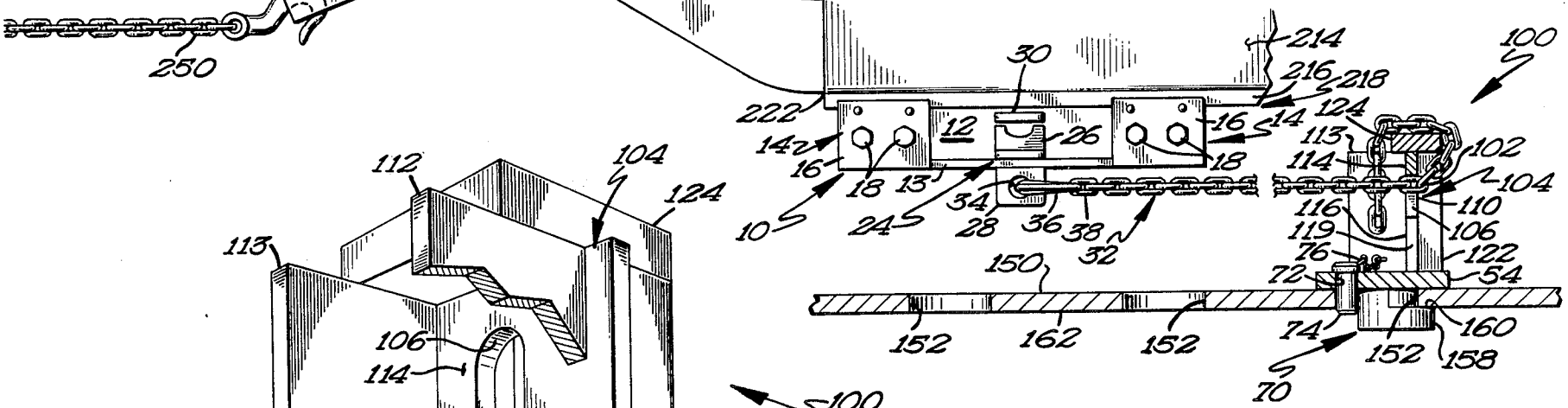
FIG. 8 is a side view of the apparatus of FIGS. 1 and 3 in use according to the teachings of the present invention.

All figures are drawn for ease of explanation of the basic teachings of the present invention only; the extensions of the figures with respect to number, position, relationship, and dimensions of the parts to form preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts in the accessories. Furthermore, when the terms "right", "left", "front", "back", "vertical", "horizontal", "right end", "left end", "first end", "second end", and similar terms are used herein, it should be understood that these terms have reference only to the structures shown in the drawings as it would appear to a person viewing the drawings and are utilized only to facilitate describing the invention.

DESCRIPTION

Figure 6:
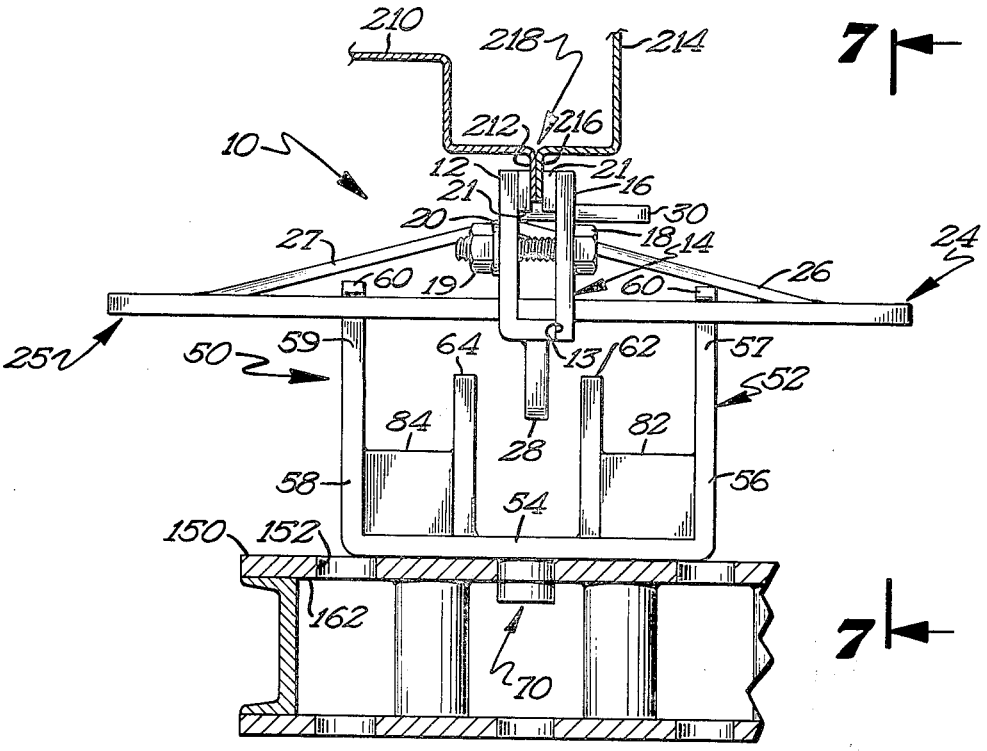
FIG. 6 is an end view of the apparatus of FIGS. 1 and 2 in use according to the teachings of the present invention.

In FIGS. 1, 6, 7, 8, and 9, a unibody clamp is generally shown and designated 10. As best seen in FIG. 1, clamp 10 includes an elongated back plate 12 shown in the preferred form as L-shaped and including a movement limiting, anti-cant, stop edge 13. Plate 12 carries adjustable jaw members generally designated 14. Jaw members 14 include a plate 16 movable towards and away from plate 12 by means of bolts 18, nuts 19, and washers 20. Replaceable gripping members 21 are further provided and removably attached to plate 12 and plate 16 by screws 22. The axis of jaw members 14 are located along the longitudinal axis of clamp 10, or, in other words, parallel to the back plate 12 of clamp 10. Adjustable jaw members 14 removably capture the pinch type weld of a vehicle along the axis of jaw members 14 of clamp 10, as will be explained further hereinafter. In the preferred embodiment, plate 16 abuts with edge 13 of plate 12 when the pinch weld is captured between gripping members 21 of jaw members 14 such that plate 16 is held in a parallel relation to the vertical leg of back plate 12 as best seen in FIG. 6.

Clamp 10 further includes, in the preferred embodiment, abutment wings 24 and 25 integrally attached to and projecting on opposite sides of plate 12 of clamp 10. In the preferred embodiment, wings 24 and 25 project in a substantially perpendicular manner from plate 12 of clamp 10 and are located on opposite sides of the axis of jaw members 14. Therefore, in the preferred form, wings 24 and 25 are substantially perpendicular to and on opposite sides of the axis of clamp 10 and are located substantially midway between the first and second jaw members 14, thus together with clamp 10, forming a cross-like member. Brace members 26 and 27 can further be provided for bracing wings 24 and 25 against plate 12 of clamp 10, respectively. In the preferred embodiment, wings 24 and 25 are arranged in a high vertical relation with respect to jaw members 14, whose purpose will be explained further hereinafter.

Clamp 10 is further shown to include connector member 28 and connector member 30 for use with a flaccid, flexible pulling member 32, shown in its preferred form as a chain. In their preferred forms, connector members 28 and 30 are flat plate members integrally attached to and projecting from back plate 12 of clamp 10 and having apertures 34 and 35, respectively therethrough.

Figure 9:
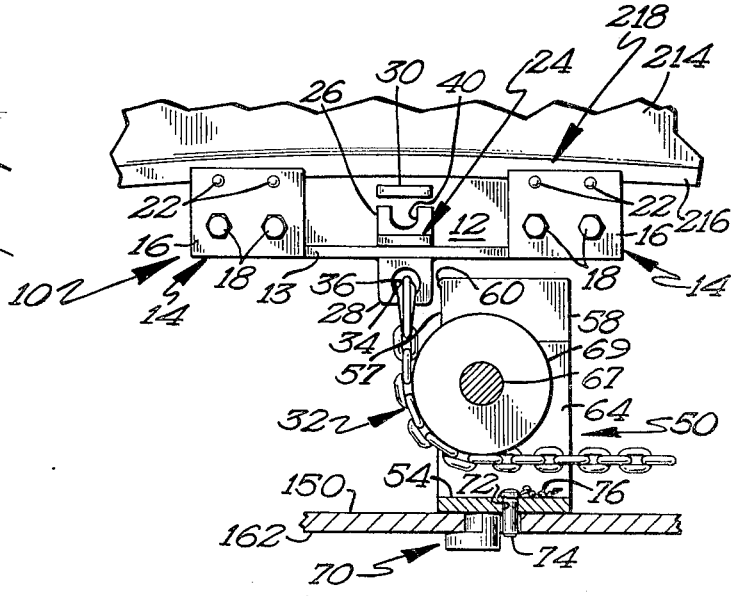
FIG. 9 is a side view of the apparatus of FIGS. 1 and 2 in use according to the teachings of the present invention.

As best seen in FIGS. 8 and 9, chain 32 includes a hook 36 located on the first end 38 of chain 32 for engaging apertures 34 or 35 of connector members 28 and 30 for attaching thereto. Other members for attaching first end 38 of chain 32 to clamp 10 can be used and are intended to be embraced by the appended claims.

Generally, connector member 28 depends in a parallel manner from back plate 12 and is generally used when the counterforce to be exerted by clamp 10 lies along the axis of jaw members 14. Connector member 28 can also be used when it is desired to exert a force on the unibody frame via clamp 10, as will be explained further hereinafter.

Connector member 30 projects perpendicularly from back plate 12 and may be used to anchor the vehicle or used when the force to be exerted on clamp 10 lies perpendicular to the axis of jaw members 14, as will be explained further hereinafter.

It should be noted that if it is desired to have connector member 30 and abutment wing 24 formed on clamp 10, it may be necessary to form an aperture, such as 40, in brace 26 to allow sufficient space for insertion of hook 36 into aperture 35 of connector member 30.

It should be noted at least from the orientation of connector member 30, that clamp 10 is shown for use on the right side of the vehicle. It will be immediately be apparent that a clamp 10 for use with the left side of the vehicle can be provided, or that clamp 10 can be provided allowing both right or left operation.

In FIGS. 2, 6, 7, and 9, a member 50 for accepting the counterforce from clamp 10 in a substantially horizontal manner is shown in a first preferred form as a hold down fork and down pull unit. Fork 50 generally includes a U-shaped stop member 52 including a flat, bottom, center section 54, a first upstanding arm 56, and a second upstanding arm 58. In the preferred embodiment, arms 56 and 58 are perpendicularly attached to the oppoisite ends of center section 54. On the abutment ends 57 and 59 of arms 56 and 58, respectively, projecting members 60 are provided, whose purpose will be explained further hereinafter.

Fork 50 is also shown to include a third upstanding arm 62 and a fourth upstanding arm 64 spaced from arm 62. Arms 62 and 64 are arranged perpendicularly to center section 54 between and parallel to arms 56 and 58. Apertures 66 and 68 are further provided in arms 62 and 64, respectively, for removably receiving a pin 67. Pin 67, washer 78, and cotter pin 80 removably and rotatably mounts a pulley 69 whose purpose will be explained further hereinafter.

Fork 50 is further shown to include support webs 82 and 84 for bracing between arms 56 and 62 and between arm 58 and 64, respectively. Apertures 86 and 88 are further provided in arms 56 and 58, respectively, for allowing insertion of pin 67 into apertures 66 and 68 of arms 62 and 64, respectively.

Fork 50 is also shown to include an attachment member 70 including an aperture 72 formed in center section 54 of fork 50 and a pin 74 attached to fork 50 by a flexible chain 76, whose purpose will be explained further hereinafter.

Figure 3:
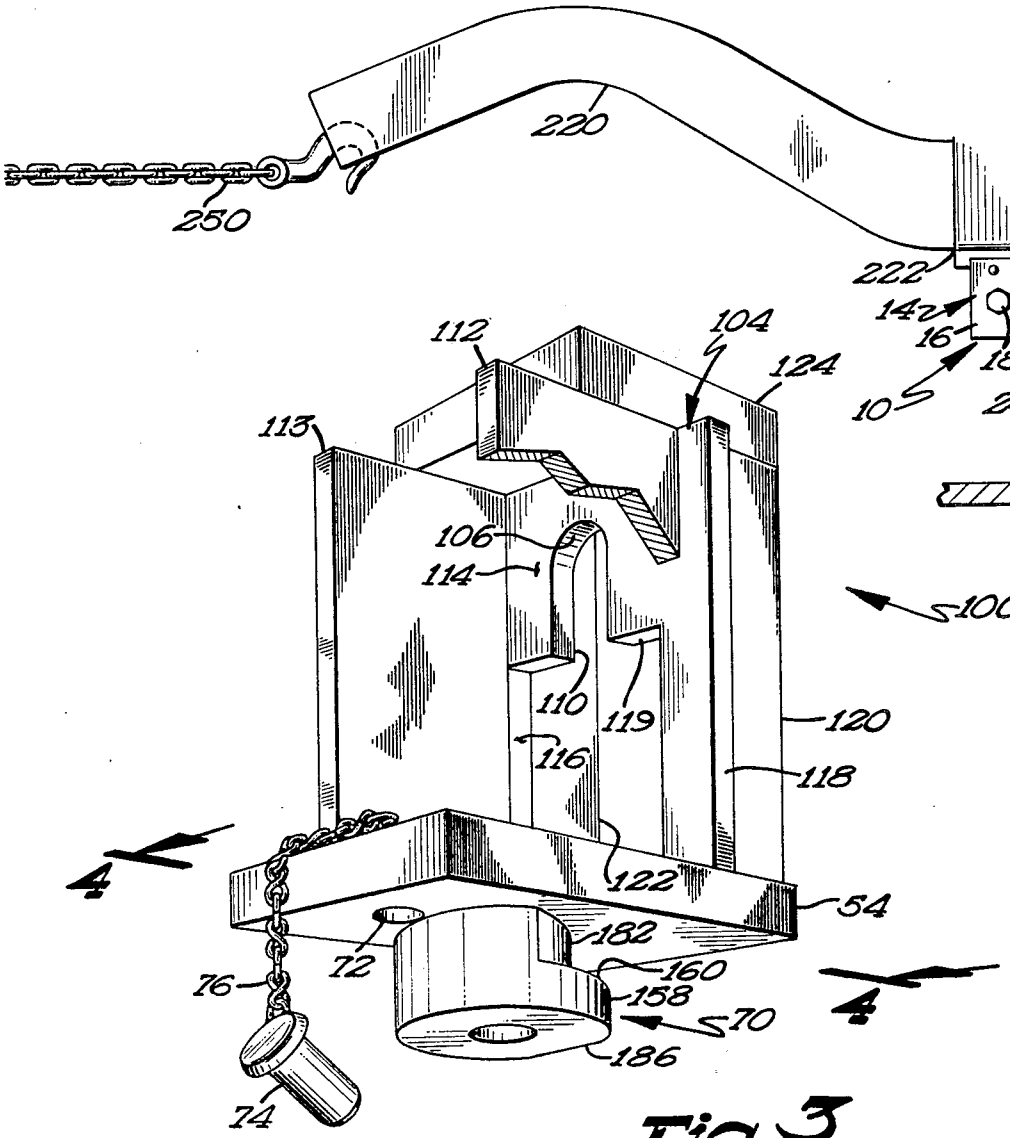
FIG. 3 is a perspective view of a member which can be utilized with the apparatus of FIG. 1.

In FIGS. 3 and 8, a member 100 for accepting the counterforce from clamp 10 in a substantially horizontal manner is shown in a second preferred form as an elevated chain hook and shortner apparatus. Apparatus 100 grasps and holds the second end 102 of chain 32 at an elevated position. Apparatus 100 includes an inverted U-shaped member 104 having a first face 110 and a second face 114, and having a first leg 116 and a second leg 118. Apparatus 100 further includes an inverted slot 106 formed in member 104 and extending in a substantially vertical direction from a removed portion 119 of U-shaped member 104. Slot 106 should be of a width allowing insertion of chain 32 in a vertical direction but preventing movement of chain 32 in a horizontal direction, as best seen in FIG. 8. As seen in FIG. 8, the links of chain 32 are alternatively oriented in a substantially vertical orientation and a substantially horizontal orientation, as is conventional. Second end 102 of chain 32 is grasped by member 104 in that a vertically oriented chain link is vertically inserted into slot 106, whose width is substantially equal to the widths of the links. Thus, chain 32 is prevented from moving in a horizontal direction in that the horizontally orientated link following the vertically oriented link within slot 106 will abut face 110 of member 104 adjacent to slot 106.

Member 104 is integrally attached and upstands from a flat, bottom, center section 54 in a substantially vertical manner. Two sides members 120 and 122 are attached perpendicularly to first face 110 of member 104 adjacent to the ends thereof and attached to and upstanding from section 54 in a substantially vertical manner such that side members 120 and 122 abut with and extend away from first face 110 of legs 116 and 118 of member 104. In a similar manner, side members 112 and 113 are attached perpendicularly to second face 114 of member 104 adjacent to the ends thereof and attached to and upstanding from section 54 in a substantially vertical manner such that side members 112 and 113 abut with and extend away from second face 114 of legs 116 and 118 of member 104. A top 124 is further provided and attached to side members 120 and 122, side members 112 and 113, and member 104 in a substantially perpendicularly manner such that top 124 is parallel to center section 54.

It can now be appreciated that side members 120, 122, 112, and 113 and top 124 support and rigidify member 104 in a substantially vertical manner such that member 104 can receive a large counterforce in direction perpendicular thereto without deflection. As best seen in FIG. 3, slot 106 is held in a spaced relation above section 54 of apparatus 100 by U-shaped member 104 and side members 112, 113, 120 and 122.

Apparatus 100 further includes an attachment member 70 including an aperture 72 formed in section 54 of apparatus 100 and a pin 74 attached to apparatus 100 by a flexible chain 76, whose purpose will be explained further hereinafter.

As best seen in FIGS. 4, 5, 6, 7, 8, and 9, attachment member 70 allows the attachment of fork 50 and apparatus 100 to a support surface 150 having an array of regularly shaped apertures 152 extending therethrough in a substantially vertical manner, allows fork 50 and apparatus 100 to self-align, and allows fork 50 and apparatus 100 to be substantially in line with counterforces, as will be explained further hereinafter.

Support surface 150 in the preferred embodiment is the tread member of a vehicle frame and body repairing and straightening apparatus. Support surface 150 has a finite thickness and, in the preferred form, apertures 152 are circular in shape.

Attachment member 70 is formed from a body portion 154 having a cross sectional size substantially equal to but slightly less than the size of support surface aperture 152. In the preferred embodiment, body portion 154 is L-shaped including a vertical leg 156 and a horizontal leg 158 attached together at their first ends. Horizontal leg 158 defines a lip 160 for abutting against the bottom surface 162 of support surface 150, as will be explained further hereinafter.

The second end of vertical leg 156 is attached to section 54 of fork 50 or apparatus 100. Lip 160 and section 54 define a removed portion 164 of a thickness substantially equal to but slightly greater than the thickness of support surface 150. Therefore, body portion 154 can be vertically inserted into aperture 152 such that horizontal leg 158 substantially fills aperture 152. Upon continued downward movement, section 54 will rest on support surface 150 such that attachment member 70 can be moved in a first lateral direction parallel to the support surface 150, as shown in a direction to the right in FIG. 4. In this position, support surface 150 is engaged by attachment member 70 within removed portion 164.

Figure 4:
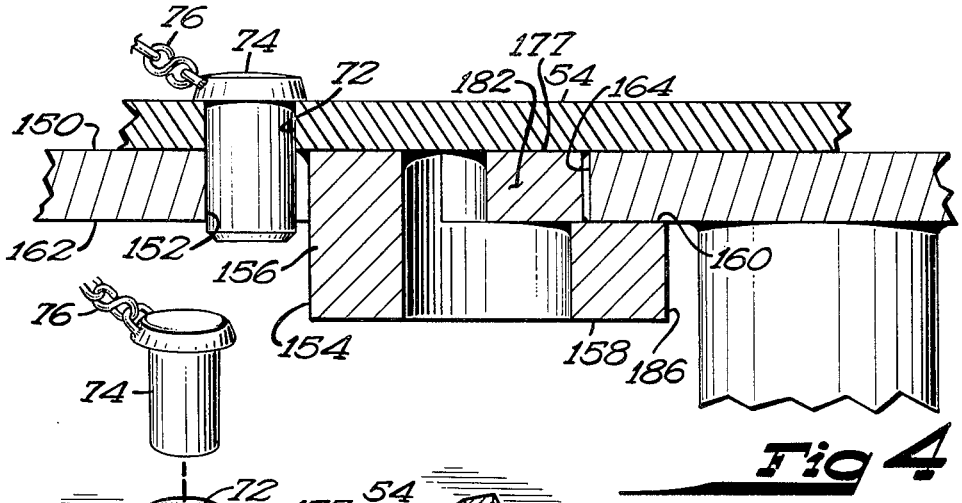
FIG. 4 is a cross sectional view of the apparatus of FIGS. 2 and 3 according to section line 4—4 of FIGS. 2 and 3.

After attachment member 70 has been moved in the first lateral direction such that attachment member engages support surface 150 within removed portion 164, pin 74 may be inserted through aperture 72 of section 54 into support surface aperture 152 adjacent to attachment member 70 to prevent attachment member 70 from moving in a second lateral direction opposite to the first lateral direction and for preventing unintentional removal of attachment member 70 from support surface aperture 152, as shown in a direction to the left in FIG. 4. It should also be noted that attachment member 70 is also unable to move in the first lateral direction, rightward in FIG. 4, in that attachment member 70 abuts with the edge of aperture 152 within removed portion 164.

Figure 5:
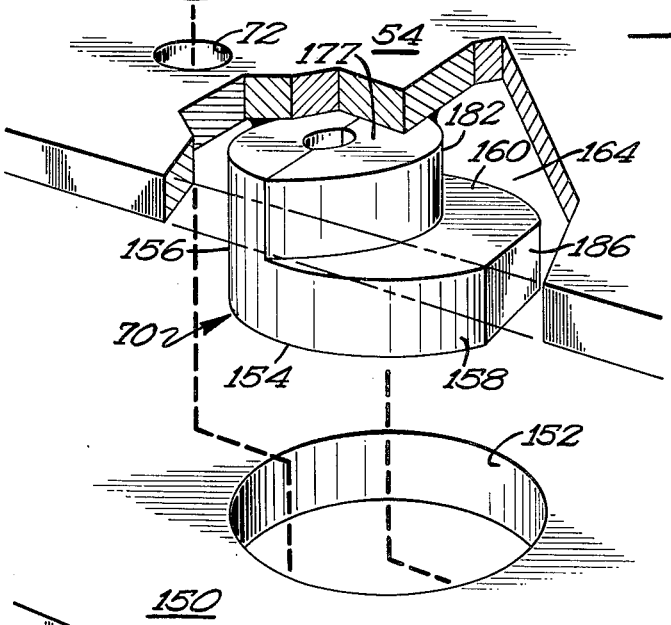
FIG. 5 is an exploded perspective view of the apparatus of FIG. 4 with portions of the apparatus broken away.
Figure 5:
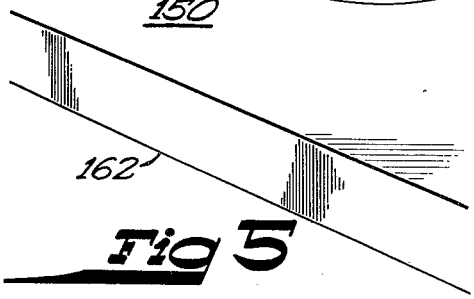

Leg 158 may optionally include a flat end portion 186, best seen in FIG. 5, for transferring the counterforce from attachment member 70 to bottom surface 162 of support surface 150 along a line instead of a point to reduce the shearing effect of lip 160 on bottom surface 162 of support surface 150 as will be explained further hereinafter.

Attachment member 70 is manufactured, in the preferred embodiment, according to the following steps, explained in reference to FIG. 10. First, a thick wall tubing 170 is obtained of a diameter substantially equal to but slightly less than the diameter of support surface aperture 152 and of the desired height. Tubing 170 should be of a height greater than the thickness of support surface 150 such that the thickness of leg 158 of attachment member 70 is of a sufficient size to transfer the torque force 150 to support surface 150 without damage to itself, as will be explained further hereinafter.

A first saw cut 172 is made along a cord of the circular diameter of tubing 170 and of a depth substantially equal to but slightly greater than the thickness of support surface 150. A second saw cut 174 is made parallel to first saw cut 172 and also along a cord of the circular diameter of tubing 170 at a depth substantially equal to but slightly greater than the thickness of support surface 150, or in other words, equal to the depth of first saw cut 172. In the preferred embodiment, first and second saw cuts 172 and 174 are parallel with the vertical center line of tubing 170. Also, in the preferred embodiment, the first and second saw cuts are located on opposite sides of the vertical center line of tubing 170 and the distance of the first saw cut away from the center line of tubing 170 is equal to the distance of the second saw cut 174 is away from the center line of tubing 170, such that the length of the cuts 172 and 174 through tubing 170 are equal.

A third saw cut 176 is then made perpendicular to the vertical center line of tubing 170 at a depth from top 177 of tubing 170 substantially equal to but slightly greater than the thickness of support surface 150. Cut 176 is made to intersect with first and second saw cuts 172 and 714. Thus tubing 170 is divided into three volumes, a first L-shaped volume 178 defined by first saw cut 172 and third saw cut 176, a second waste volume 180 defined by first saw cut 172, second saw cut 174, and third saw cut 176, shown as shaded in FIG. 10, and a third volume 182 defined by second saw cut 174 and third saw cut 176.

Waste volume 180 is then removed and discarded. Volume 182 is then moved over such that the edge of volume 178 formed by first saw cut 172 abuts with the edge of volume 182 formed by second saw cut 174. Volume 182 is then attached to volume 178 such as by welding. It should be noted that, in the preferred form, since the lengths of saw cuts 172 and 174 are equal, the top portion of volume 178 and volume 182 form an elliptical member, as best seen in FIG. 5. A fourth saw cut 184 can also be made or volume 178, or in other words, on horizontal leg 158 of attached member 70 forming a flat end portion 186, as best seen in FIG. 5. The finished member is shown in its preferred form as attachment member 70.

Attachment member 70 is then attached to section 54 and aperture 72 is then formed directly in front of attachment member 70, shown to the left of attachment member 70 in FIG. 4, allowing insertion of pin 74, as will be explained further hereinafter. It will be immediately apparent, that at the option of the manufacturer, apertures 72 may be formed in section 54 before or after attachment member 70 is attached thereto.

It can now be appreciated that due to the regularly shaped apertures 152, shown in their preferred form as circular in shape, and due to attachment member 70 of the present invention, fork 50 and apparatus 100 are able to be positioned in any orientation, through a complete 360 degree circle about the center of any aperture 152, such that fork 50 and apparatus 100 are able to accept the counterforce at any angle, 360 degrees around itself. This is particularly advantageous with respect to fork 50, when it is used as a down pull unit, and with respect to apparatus 100. For example, fork 50 can be positioned such that chain 32 is directed at any angle with respect to a vehicle by pulley 69. Similarly, apparatus 100 can be positioned to accept a longitudinal counterforce, a latitudinal counterforce, or other counterforces at any angle with respect thereto.

OPERATION

Several automobile manufacturers have introduced vehicles having unibody type construction. Generally, as best seen in FIG. 6, unibody vehicles include a first bottom sheet member 210 forming the bottom covering of the unibody frame, and having a lip 212 and a second sheet member 214 having a lip 216 forming the rocker panels and floor boards of the unibody frame. Lip 212 and lip 216 are then welded together, forming a pinch type weld generally shown and designated 218. Due to the bends in sheet members 210 and 214, a rigid support member is formed, thus eliminating the necessity of conventional frame members in the vehicle frame. Conventional frame members 220, as best seen in FIG. 8, are attached to the front and rear of the unibody frame for extending around the wheel wells of the vehicle.

Previous to the present invention when it was desired to repair a damaged vehicle having conventional frame members, the vehicle was anchored by the use of suitable anchoring devices. Such anchoring devices held the vehicle by attachment to a frame member adjacent to the damage, for example, to cross members of the frame member of the vehicle. However, with unibody type vehicles, the anchoring of the vehicle adjacent to the damage by such devices is not possible since attachment of such devices with all portions of the vehicle cannot be made. Also if the vehicle was anchored on an end opposite to the damaged end, and thus remote to the damage, it is possible to undesirably stretch the unibody, thus causing damage thereto. Therefore, apparatus allowing attachment to the unibody portion of the vehicle is necessary to prevent such an occurrence.

Previous known apparatus, before the present invention, consisted of apparatus attached to the vehicle upon which a chain was attached and anchored at an angle to a surface below the vehicle. Therefore, when repair forces were exerted on the vehicle, a large downward counterforce was exerted on the vehicle bending the unibody downward. To prevent this downward counterforce, it was necessary to place jacks or support blocks under the vehicle for accepting this downward counterforce upon which the frame would abut for example, at the cowl area of the vehicle, as generally designated 222 in FIG. 8. Such a procedure could require a large expenditure of energy and time, thus increasing the repair costs.

Further, due to this large downward counterforce, previous apparatus had a tendency to twist and rip pinch weld 218 from the unibody portion of the vehicle, thus creating unnecessary and undesired damage to the vehicle and requiring unnecessary and undesired expenditures of time and effort to repair.

Additionally, if the vehicle was damaged such that the unibody included an upward bent, especially in the cowl area 222 of the vehicle, prior to the present invention it was necessary to anchor the bend, and jack up the remaining portions of the vehicle to the same height as the bend, thus straightening the frame. Such a procedure can also be costly and time consuming.

The present invention solves these problems by providing the various accessories to an apparatus for repairing and straightening.

In particular, with the present invention, clamp 10 can be removably attached to pinch weld 218 of the unibody portion of the vehicle. To accomplish this attachment, bolts 18, nuts 19 and washers 20 are loosened allowing movable plates 16 to be separated from plate 12 thus forming a gap between gripping members 20. Clamp 10 is then raised adjacent to pinch weld 218 such that pinch weld 218 is located within the gap between gripping members 20. Bolts 18, nuts 19, and washers 20 are then tightened drawing plate 16 toward plate 12 and thus capturing weld 218 between grip members 21 of adjustable jaw members 14. Therefore, clamp 10 is securely attached to pinch weld 218 of the unibody vehicle.

A first preferred embodiment of a member for accepting the counterforce from clamp 10 in a substantially horizontal manner to thus substantially reduce the necessity for the use of supporting blocks or jacks in straightening the frame of the vehicle is shown in its preferred form as fork 50.

Fork 50 is positioned within the apparatus for repairing and straightening, not completely shown. Fork 50 is laid horizontally on support surface 150 such that center section 54 is substantially perpendicular to support surface 150. In this position, fork 50 can be slid to the desired position such that pinch weld 218 is located between arms 56 and 58 of stop member 52 and such that fork 50 lies substantially adjacent to and in front of abutment arms 24 and 25 of clamp 10. It will be immediately apparent that, for best results, fork 50 should be positioned such that pinch weld 218 is located substantially midway between arms 56 and 58 of stop member 52, although an offset position may suffice. At that time, fork 50 is tipped to a vertical position such that center section 54 is substantially parallel to support surface 150 as shown in FIGS. 6 and 7 however with attachment member 70 being located outside of support surface aperture 152.

Attachment member 70 is then inserted into aperture 152 of support surface 150. Fork 50 is positioned such that horizontal leg 158 of attachment member 70 lies directly in line with and above aperture 152. At this time, attachment member 70 can be dropped into aperture 152 until the bottom surface of center section 54 abuts with the top surface of support surface 150.

Figure 7:
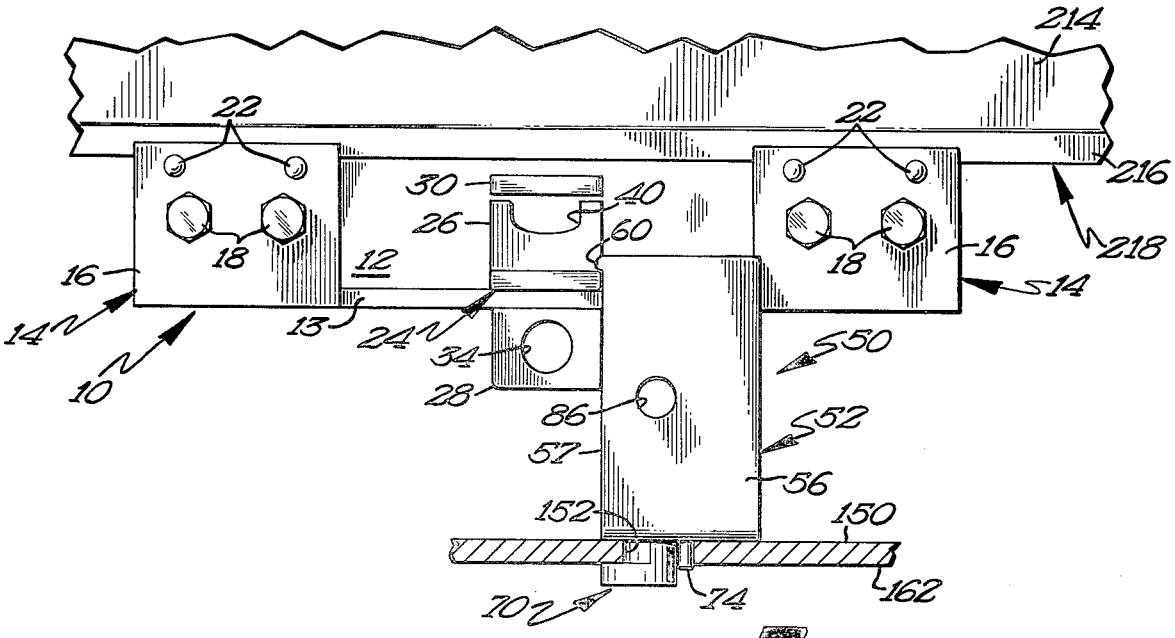
FIG. 7 is a side view of the apparatus of FIG. 6 according to view line 7—7 in FIG. 6.

Fork 50 is then moved in a first lateral direction parallel with support surface 150, shown to the left in FIG. 7, such that support surface 150 engages attachment member 70 within removed portion 164 formed between lip 160 of attachment member 70 and center section 54. At this time, pin 74 is dropped through aperture 72 of center section 54 into aperture 152 of support surface 150 adjacent to attachment member 70, as best seen in FIGS. 4 and 7.

It should be noted that some means must be placed on both sides of the vehicle to securely anchor the vehicle to support surface 150. Any means of anchoring vehicle can be used in addition to clamp 10 and fork 50 to securely anchor the vehicle and prevent movement thereof when the repair force is applied, but an additional set of the disclosed apparatus is clearly preferred. After both sides have been anchored, the repair force can then be applied to the vehicle at the desired locations.

The repair force is applied to the damaged portions of the vehicle, preferably at the same angle as but in the opposite direction as the damaging force occurred. It should be noted that fork 50 and clamp 10 should be positioned such that, as the repair force is applied to the vehicle, wings 24 and 25 of clamp 10 move toward stop member 52 of fork 50.

As best seen in FIGS. 6 and 7, initially, the vehicle will move on support surface 150 until one of the arms 56 and 58 of stop member 52 engages with one of the wings 24 and 25. After continued movement of the vehicle, fork 50 will rotate about attachment member 70 such that fork 50 self-aligns with clamp 10. In this aligned position, arm 56 and arm 58 simultaneously engage wings 25 and 24, respectively, located on opposite sides of the axis of jaw members 14.

It can now be appreciated that attachment member 70 allows the self-alignment of the accepting member, shown in its first preferred form as fork 50. Due to the regular shape of apertures 152, especially the preferred circular shape, attachment member 70 is allowed to rotate therein such that fork 50 is able to accept the counterforce of clamp 10 substantially in line, as will be explained further hereinafter. Thus, fork 50 aligns itself such that arms 56 and 58 simultaneously engage wings 25 and 24, respectively, as mentioned hereinbefore.

Further, pinch weld 218 may be bent such that as the repair force is applied, the angle of clamp 10 relative to support surface 150 may change. Due to its ability to self-align, the angle of fork 50 will also change relative to clamp 10 such that it will accept the counterforce of clamp 10 substantially in line.

Upon continued application of the repair force, clamp 10 will convey a counterforce via wings 25 and 24 to arms 56 and 58, respectively, of stop member 52. As best seen in FIGS. 6 and 7, clamp 10 will exert a horizontal counterforce on fork 50 parallel to support surface 150. Due to location of wings 24 and 25 in a high vertical relation with respect to jaw members 14, wings 24 and 25 are in a close vertical position to pinch weld 218 and are better able to convey the counterforce exerted by pinch weld 218 of the vehicle on clamp 10 in a substantially horizontal manner.

It should further be noted that no physical connection of any kind is made between clamp 10 and fork 50 except for abutment between stop member 52 and wings 25 and 24. Therefore, wings 25 and 24 are free to slide in a vertical direction on stop member 52, however, are prevented from moving in a horizontal direction due to the abutment of clamp 10 with stop member 52. Therefore, fork 50 is better able to accept the counterforce from wings 24 and 25 in a substantially horizontal manner.

The value of the use of the fork 50 in relation to clamp 10 according to the teachings of the present invention can now be more fully appreciated. If the repair force is directed substantially horizontally to the vehicle, such as when it is desired to stretch the frame of the vehicle, no vertical force components are placed on the vehicle which tend to bend pinch weld 218 in that fork 50 is able to accept the counterforce substantially in line and in a substantially horizontal manner. Therefore, no support blocks of any kind are required in that no vertical force components are exerted on pinch weld 218.

If the repair force is directed at a vertical angle with respect to the vehicle, vertical force components will be applied to pinch weld 218 by the repair force. However, since fork 50 is able to accept the counterforce substantially in line and in a substantially horizontal manner, support apparatus, such as support blocks in the case of a downward repair force angle, or vertical chain anchoring apparatus, in the case of an upward repair force angle, although required in addition to the present invention, are not required to have large force accepting capabilities as previously required in connection with previous apparatus in that, the vertical force component will not be as large. Therefore, such support apparatus can be of a small size and weight which can easily be used in an apparatus for repairing and straightening without a large expenditure of time or energy.

It should be noted that the present invention can eliminate large vertical counterforces which must be accepted by the supporting apparatus used by previously known devices and which can cause damage to the vehicle. For example, if a large vertically downward force is accepted by the supporting apparatus, the vehicle will be subjected to a force from the supporting apparatus which will tend to cause unnecessary damage, thus requiring further expenditure of time and effort to repair.

Additionally, since the counterforce conveyed from clamp 10 to fork 50 is substantially in line, and in a substantially horizontal manner, clamp 10 will not have a tendency to twist the pinch weld 218 and tear it from the unibody of the vehicle, as was previously a problem with prior known apparatus.

It should also be noted that wings 25 and 24 can abut with arms 56 and 58, respectively, at any vertical location of stop member 52 from a top position defined by projecting members 60, as explained further hereinafter, to a bottom position such that connector member 28 abuts with support surface 150. Therefore, fork 50 can be used on various sizes of vehicle having various clearance levels between pinch weld 218 and support surface 150. For vehicles, such as pickup trucks, having very high clearance levels, such as the vehicle shown in FIGS. 6 and 7, wings 25 and 24 of clamp 10 may have a small tendency of creeping over stop member 52 when the repair force is placed on the vehicle. To prevent such an occurrence, projecting members 60 formed on arms 56 and 58 stop any vertical movement of wings 24 and 25 of clamp 10 beyond member 60 and thus prevent wings 25 and 24 from slipping over the top of stop member 52 as best seen in FIG. 7.

As best seen in FIG. 6, arms 62 and 64 do not necessarily abut with wings 25 and 24, and in fact, in the preferred embodiment, arms 62 and 64 do not abut with wings 25 and 24 of clamp 10. Arms 62 and 64 are located within stop member 52, in the preferred embodiment, for the purpose of rotatably mounting pulley 69. Therefore, arms 62 and 64 need not be present within fork 50 if it is not desired to mount pulley 69 therein.

As can now be understood, counterforce placed on stop member 52 is conveyed to attachment member 70 and to support surface 150. Therefore, attachment member 70 is subjected to a horizontal force parallel to support surface 150 and a torque force due to the spacing of the counterforce from clamp member 10 to fork 50 at a point above attachment member 70. The horizontal force on member 70 will attempt to move attachment member 70 in a lateral direction parallel to support surface 150. However, as previously explained, attachment member 70 is unable to move in a lateral direction due to the insertion of pin 74.

The torque force conveyed to attachment member 70 will cause twisting of attachment member 70 in support surface aperture 152. However, due to the novel design of attachment member 70, this torque force is readily transferred to support surface 150. When attachment member 70 begins to twist, lip 160 will abut against bottom surface 162 of support surface 150 and the area of center section 54 located adjacent to aperture 72 will abut with the top surface of support surface 150. Therefore, attachment member 70 readily conveys the torque force to support surface 150 and will not be pulled from aperture 152.

It should be noted that as a result of flat end portion 186, the force conveyed by lip 160 to bottom surface 162 of support surface 150 will be along a line rather than a point, as would be the case if portion 186 were not provided. Portion 186 removes the shearing effect of lip 160 on support surface 150 which may exist if the force was transferred only at a point.

It should further be noted that pin 74 and lip 160 of attachment member 70 are located on opposite sides of the body portion 154 such that the conveyed torque force tends to produce a downward force at pin 74 and an upward force on lip 160 in that the torque force will tend to vertically twist attachment member about a point located at the center of aperture 152 of support surface 150. This prevents pin 74 from accidentally jumping from aperture 72, and also, pin 74 is not under a large force allowing pin 74 to be of a small size.

A second preferred embodiment of a member for accepting the counterforce from clamp 10 in a substantially horizontal manner to thus substantially reduce the necessity for the use of supporting blocks or jacks in straightening the frame of the vehicle is shown in its preferred form as apparatus 100.

After clamp 10 is positioned on pinch weld 218 as previously explained, apparatus 100 is positioned upon support surface 150 of the apparatus for repairing and straightening in a substantially similar manner as previously explained with respect to fork 50. In position, attachment member 70 of apparatus 100 is located in a support surface aperture 152 such that, in the preferred embodiment, inverted slot 106 lies perpendicular with and in line with the axis of clamp 10, or in other words, along the axis of pinch weld 218.

Hook 36 of chain 32 is inserted into aperture 34 of connector member 28 such that first end 38 of chain 32 is attached to clamp member 10. For vehicles having small clearance between pinch weld 218 and support surface 150, such as the vehicle shown in FIG. 8, second end 102 of chain 32 is then pulled through the removed portion 119 of member 104 until it is pulled tight. Second end 102 of chain 32 may then be moved vertically upward into slot 106 as best seen in FIG. 8. Chain 32 is moved vertically until chain 32 lies in a substantially horizontal location such that chain 32 lies substantially in line with connector member 28, as best seen in FIG. 8. The end of chain 32 is then thrown over top 124 of apparatus 100 to prevent chain 32 from falling from slot 106 of member 104.

It should be noted that chain 32 can also be held in various elevated positions by use of apparatus 100 by other techniques. For example, chain 32 can be placed such that it extends over and around top 124 and then extends into slot 106 of member 104 such that second end 102 of chain 32 is prevented from moving in a horizontal direction to the right, as viewed in FIG. 8, within slot 106.

It should be noted that some means must be placed on both sides of the vehicle to securely anchor the vehicle to support surface 150. Any means of anchoring vehicle can be used in addition to clamp 10 and apparatus 100 to securely anchor the vehicle and prevent movement thereof when the repair force is applied, but an additional set of the disclosed apparatus is clearly preferred.

The repair force is applied to the damaged portions of the vehicle, preferably at the same angle the damaging force occurred. It should be noted that apparatus 100 and clamp 10 should be positioned such that, as the repair force is applied to the vehicle, chain 32 tightens between connector member 28 and apparatus 100 as best seen in FIG. 8.

As chain 32 tightens due to the repair force, apparatus 100 will self-align such that chain 32 lies directly in line with the counterforce, due to attachment member 70 in a similar manner as previously explained in reference to fork 50.

It can now be realized that since chain 32 lies in a substantially horizontal position, the counterforce is transferred substantially in line from clamp 10 to apparatus 100. If chain 32 is in a horizontal position, chain 32 is unable to convey a vertical force component on apparatus 100. Therefore, only a horizontal component is transferred and due to the self-alignment of apparatus 100, apparatus 100 will be substantially in line with the counterforce of clamp 10. Therefore, as previously explained in reference to clamp 10 and fork 50, support apparatus are not required in conjunction with the present invention when the repair force is exerted on the vehicle in a substantially horizontal manner. Additionally, if the repair force is exerted on the vehicle at a vertical angle, the support apparatus need not have large force accepting capabilities, as previously explained, and clamp 10 will not have the tendency to twist pinch weld 218 from the unibody, or cause other damage to the vehicle caused due to the exertion of counterforces on the vehicle by supporting apparatus.

It should be noted that when it is desired to have a vertical force component exerted on the unibody frame, for example, when the unibody frame has an upward bend, apparatus 100 also allows a vertical force component to be exerted on the unibody frame. Chain 32 can be placed within slot 106 of member 104 such that it does not lie in a substantially horizontal position, but rather angles towards the vehicle. Second end 102 of chain 32 is positioned such that when the unibody is straightened to the desired position, chain 32 will lie in a substantially horizontal position.

Therefore, when the repair force is applied, a small vertical force component is placed on the unibody clamp thus straightening the unibody of the vehicle while repairing other damage to the vehicle. As the unibody straightens, chain 32 will move towards a horizontal position, in that clamp 10 moves vertically downward with the unibody since clamp 10 is attached to the unibody frame. However, when the unibody frame is straightened to the desired position, clamp 10 will be in such a position such that chain 32 lies in a substantially horizontal manner. Therefore, as previously explained, in this position chain 32 only transfers the counterforce substantially in line to apparatus 100 and applies no vertical repair force.

As previously explained, attachment member 70 will convey any resultant torque force of apparatus 100 to support surface 150 such that attachment member 70 will not vertically twist out of support surface aperture 152, however, will still allow apparatus 100 to self-align on support surface 150.

It should be noted that although apparatus 100 is shown in use with a unibody clamp 10, apparatus 100 may also be used with other types of vehicle attachment members for use with unibody type vehicles, or vehicles having standard type frames. Apparatus 100 can thus be used to anchor a vehicle with the use of anchor chains attached by suitable apparatus, when it is desired to grasp the chain at an elevated position, or for other similar purposes.

As best seen in FIG. 9, fork 50 can also be used as a down pull unit when it is desired to put a downward force on clamp 10. As shown in FIG. 9, pinch weld 218 of the unibody frame has an upward bend therein. After clamp 10 has been attached to pinch weld 218, fork 50 having pulley 69 rotatably mounted between arms 64 and 66 by pin 67 as previously explained, is positioned on support surface 150 in a similar manner as previously explained in reference to fork 50. Also, as previously explained, attachment member 70 extends into support surface aperture 152 attaching fork 50 to support surface 150. After fork 50 has been attached to support surface 150, chain 32 is passed around pulley 69 and hook 36 is hooked into aperture 34 of connector member 28. A repair force can then be placed on second end 102 of chain 32. As the repair force is placed on chain 32, fork 50 will align with clamp 10 such that chain 32 is substantially in line with connector member 28 due to self-aligning attachment member 70 as explained hereinbefore. Upon continued application of the repair force, chain 32 will exert a downward vertical force on clamp 10 which will pull pinch weld 218 of the unibody frame downward.

It should further be noted that fork 50 when used as a down pull unit can also direct chain 32 at an angle with respect to the vertical. For example, first end 38 of chain 32 can be attached to the vehicle at a point midway between its assumed two pinch welds 218 on the opposite sides of the vehicle, and fork 50 can be located on support surface 150 vertically below one of the pinch welds 218 of the vehicle. Therefore, a repair force can be applied to chain 32 in a manner to repair any damage to the vehicle at the location of the attachment of first end 38 of chain 32.

As previously explained, attachment member 70 will convey any resultant torque force of fork 50 to support surface 150 such that attachment member 70 will not vertically twist out of support surface aperture 152, however, will still allow fork 50 to self-align on support surface 150.

It can now be realized, that when it is desired to use fork 50 as a pull down member, arms 56 and 58 are not used and therefore can be removed if desired. However, due to the construction of the preferred embodiment, fork 50 can be used for several different operations, thus greatly reducing the number of accessories required.

Also, when it is desired to pull pinch weld 218 in a direction perpendicular thereto, for example, when a vehicle has been hit in the side pushing the unibody frame inward, clamp 10 can also be used. Clamp 10 is attached to pinch weld 218 as previously explained. Chain 250 of the force applying member is then attached to connector member 30. At that time, chain 250 can be tightened pulling clamp 10 outward and thus straightening the unibody frame.

It should also be noted that connector 30 can also be utilized in anchoring the vehicle to prevent the vehicle from moving in a latitudinal direction. For example, chain 32 could be attached to connector member 30 extending perpendicularly from pinch weld 218 and second end 102 thereof could be grasped in an elevated position by apparatus 100, also positioned perpendicularly from pinch weld 218.

Now that the basic teachings of the present invention have been explained, many extensions and variations will be obvious to one having ordinary skill in the art. For example, although clamp 10 is shown in its preferred form for grasping the pinch weld of a unibody frame, it will be immediately apparent to one skilled in the art that clamp 10 can be formed for grasping other members of a vehicle, such as the standard frame members of vehicles not having unibody type construction. Further, although clamp 10 in the preferred embodiment is shown to include wings 24 and 25 and connector members 28 and 30, it will be immediately apparent to one skilled in the art that clamp 10 may optionally include these members and may further optionally include any other similar members which are utilized to effect the teachings of the present invention. Therefore, it is intended that the clamp with or without such members be included, as defined in the appended claims.

Further, while attachment member 70 has been shown in its preferred form as manufactured by a preferred process, it is envisioned that once the present invention has been explained, other forms and other methods of manufacture will be within the skill of the art and are intended to be embraced herein, as defined in the appended claims.

Likewise, the particular structure of the preferred embodiments of clamp 10, fork 50, and apparatus 100 are set out to particularly disclose the preferred and optimized embodiments thereof, and it is envisioned that once the present invention has been explained, other structures utilizing the teachings of the present invention are within the skill of the art.

Additionally, it may be desired to invert the arrangement of wings 24 and 25 and braces 26 and 27, such that wings 24 and 25 are located in a higher vertical relation with pinch weld 218 to thus allow the counterforce to better be transferred from pinch weld 218 to wings 24 and 25.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description and all changes which come within the meaning and range of equivalency of the claims are intended to be embraced therein.

What is claimed is:

1. Apparatus for anchoring a vehicle, having a unibody type construction including at least one pinch type weld, to a support surface comprising, in combination: an elongated clamp member for grasping the pinch type weld of the unibody of the vehicle including adjustable jaw members along an axis for removably capturing the pinch type weld; means for accepting a counterforce from the clamp member in a substantially horizontal manner to substantially reduce the necessity for use of supporting apparatus in straightening the frame of the vehicle; and means, for rotation about a vertical axis, for attaching the accepting means to the support surface, for allowing rotational self-alignment of the accepting means about the vertical axis, and for allowing the accepting means to be substantially in line with the counterforce of the clamp member.

2. The apparatus of claim 1 wherein the elongated clamp member includes at least two abutment wings integrally attached to and projecting from the clamp member, with the wings being located on opposite sides of the axis of the jaw members, and wherein the accepting means comprises a stop member including arms upstanding from the support surface for abutting with the abutment wings such that the counterforce from the clamp member is conveyed in a substantially horizontal manner through the abutment wings to the stop member.

3. The apparatus of claim 2 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral directional parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

4. The apparatus of claim 3 wherein the support surface aperture is circular in shape and wherein the attachment means has a circular cross section.

5. The apparatus of claim 3 wherein the preventing means comprises a pin inserted within the support surface aperture next to the attachment means after the attachment means has been moved in the first lateral direction to an extent that the support surface engages the removed portion.

6. The apparatus of claim 3 wherein the attachment means includes an L-shaped member including a vertical leg and a horizontal leg, with the horizontal leg defining the abutting lip, wherein the vertical leg is attached to the bottom surface of the accepting means, and wherein the removed portion is defined between the horizontal leg and the bottom surface of the accepting means.

7. The apparatus of claim 3 wherein the lip of the attachment means includes a flat end portion for transferring the counterforce from the attachment means to the bottom surface of the support surface along a line and for reducing the shearing effect of the lip on the support surface.

8. The apparatus of claim 3 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accepting means.

9. The apparatus of claim 3 wherein the stop member includes the top surface abutting means which comprises, in combination: a flat, bottom section, with the bottom section of the stop member extending beyond the attachment means adjacent to the preventing means for abutting with the top surface of the support surface.

10. The apparatus of claim 2 wherein the stop member comprises a U-shaped member including first and second upstanding arms, with the arms upstanding from a center section, and with the arms of the U-shaped member being of a dimension allowing the clamp member to be located between the arms of the U-shaped member and allowing the abutment wings to abut with the arms of the U-shaped member.

11. The apparatus of claim 10 wherein the center section is generally flat and wherein the upstanding arms are perpendicularly attached to the opposite ends of the center section.

12. The apparatus of claim 11 wherein the upstanding arms further include projecting means for stopping any vertical movement of the abutment wings there beyond and thus preventing the abutment wings from slipping over the top of the upstanding arms.

13. The apparatus of claim 10 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

14. The apparatus of claim 13 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accepting means.

15. The apparatus of claim 13 wherein the accepting means includes the top surface abutting means which comprises, in combination: a flat, bottom section, with the bottom section of the accepting means extending beyond the attachment means adjacent to the preventing means for abutting with the top surface of the support surface.

16. The apparatus of claim 13 wherein the center section of the stop member extends beyond the attachment means adjacent to the preventing means for abutting with the top surface of the support surface and comprises the top surface abutting means.

17. The apparatus of claim 2 wherein the upstanding arms further include projecting means for stopping any vertical movement of the abutment wings there beyond and thus preventing the abutment wings from slipping over the top of the upstanding arms.

18. The apparatus of claim 1 wherein the clamp member further includes a connector member and wherein the accepting means comprises, in combination: a flexible pulling member including a first end and a second end; means, located on the first end of the pulling member, for attaching the pulling member to the connector member; and means for grasping and holding the second end of the pulling member at an elevated position such that the pulling member lies substantially in line with the counterforce of the clamp member.

19. The apparatus of claim 18 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

20. The apparatus of claim 19 wherein the support surface aperture is circular in shape and wherein the attachment means has a circular cross section.

21. The apparatus of claim 19 wherein the preventing means comprises a pin inserted within the support surface aperture next to the attachment means after the attachment means has been moved in the first lateral direction to an extent that the support surface engages the removed portion.

22. The apparatus of claim 19 wherein the attachment means includes an L-shaped member including a vertical leg and a horizontal leg, with the horizontal leg defining the abutting lip, wherein the vertical leg is attached to the bottom surface of the accepting means, and wherein the removed portion is defined between the horizontal leg and the bottom surface of the accepting means.

23. The apparatus of claim 19 wherein the lip of the attachment means includes a flat end portion for transferring the counterforce from the attachment means to the bottom surface of the support surface along a line and for reducing the shearing effect of the lip on the support surface.

24. The apparatus of claim 19 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accepting means.

25. The apparatus of claim 19 wherein the grasping and holding means includes the top surface abutting means which comprises, in combination: a flat, bottom section, with the bottom section of the grasping and holding means extending beyond the attachment means adjacent to the preventing means for abutting with the top surface of the support surface.

26. The apparatus of claim 18 wherein the grasping and holding means comprises a slotted member including an inverted slot for receiving the second end of the flexible pulling member, with the inverted slot being in a spaced relation from the support surface.

27. The apparatus of claim 26 wherein the slotted member is an inverted U-shaped member such that the slot extends in a substantially vertical direction from the removed portion of the U-shaped member.

28. The apparatus of claim 27 wherein the apparatus further comprises at least two side members attached perpendicularly adjacent to the opposite sides of the U-shaped member and parallel to each other for holding and supporting the U-shaped member in a substantially vertical manner.

29. The apparatus of claim 26 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

30. The apparatus of claim 29 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accepting means.

31. The apparatus of claim 29 wherein the grasping and holding means includes the top surface abutting means which comprises, in combination: a flat, bottom section, with the bottom section of the grasping and holding means extending beyond the attachment means adjacent to the preventing means for abutting with the top surface of the support surface.

32. The apparatus of claim 1 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

33. The apparatus of claim 32 wherein the support surface aperture is circular in shape and wherein the attachment means has a circular cross section.

34. The apparatus of claim 33 wherein the preventing means comprises a pin inserted within the support surface aperture next to the attachment means after the attachment means has been moved in the first lateral direction to an extent that the support surface engages the removed portion.

35. The apparatus of claim 34 wherein the attachment means includes an L-shaped member including a vertical leg and a horizontal leg, with the horizontal leg defining the abutting lip, wherein the vertical leg is attached to the bottom surface of the accepting means, and wherein the removed portion is defined between the horizontal leg and the bottom surface of the accepting means.

36. The apparatus of claim 35 wherein the lip of the attachment means includes a flat end portion for transferring the counterforce from the attachment means to the bottom surface of the support surface along a line and for reducing the shearing effect of the lip on the support surface.

37. The apparatus of claim 36 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accepting means.

38. The apparatus of claim 37 wherein the accepting means includes the top surface abutting means which comprises, in combination: a flat, bottom section, with the bottom section of the accepting means extending beyond the attachment means adjacent to the preventing means for abutting with the top surface of the support surface.

39. The apparatus of claim 32 wherein the preventing means comprises a pin inserted within the support surface aperture next to the attachment means after the attachment means has been moved in the first lateral direction to an extent that the support surface engages the removed portion.

40. The apparatus of claim 32 wherein the attachment means includes an L-shaped member including a vertical leg and a horizontal leg, with the horizontal leg defining the abutting lip, wherein the vertical leg is attached to the bottom surface of the accepting means, and wherein the removed portion is defined between the horizontal leg and the bottom surface of the accepting means.

41. The apparatus of claim 32 wherein the lip of the attachment means includes a flat end portion for transferring the counterforce from the attachment means to the bottom surface of the support surface along a line and for reducing the shearing effect of the lip on the support surface.

42. The apparatus of claim 32 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accepting means.

43. The apparatus of claim 42 wherein the accepting means includes the top surface abutting means which comprises, in combination: a flat, bottom section, with the bottom section of the accepting means extending beyond the attachment means adjacent to the preventing means for abutting with the top surface of the support surface.

44. The apparatus of claim 32 wherein the accepting means includes the top surface abutting means which comprises, in combination: a flat, bottom section, with the bottom section of the accepting means extending beyond the attachment means adjacent to the preventing means for abutting with the top surface of the support surface.

45. Apparatus for anchoring a vehicle to a support surface comprising, in combination: a flexible pulling member including a first end and a second end; means, located on the first end of the pulling member, for attaching the pulling member to the vehicle; means for grasping and holding the second end of the pulling member at an elevated position such that the pulling member lies in a substantially horizontal manner and substantially in line with the counterforce conveyed by the pulling member to substantially reduce the necessity for use of supporting apparatus in straightening the frame of the vehicle; and means, for rotation about a vertical axis, for attaching the grasping and holding means to the support surface, for allowing rotational self-alignment of the grasping and holding means about the vertical axis, and for allowing the grasping and holding means to be substantially in line with the counterforce of the pulling member.

46. The apparatus of claim 45 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

47. The apparatus of claim 46 wherein the support surface aperture is circular in shape and wherein the attachment means has a circular cross section.

48. The apparatus of claim 46 wherein the preventing means comprises a pin inserted within the support surface aperture next to the attachment means after the attachment means has been moved in the first lateral direction to an extent that the support surface engages the removed portion.

49. The apparatus of claim 46 wherein the attachment means includes an L-shaped member including a vertical leg and a horizontal leg, with the horizontal leg defining the abutting lip, wherein the vertical leg is attached to the bottom surface of the grasping and holding means, and wherein the removed portion is defined between the horizontal leg and the bottom surface of the grasping and holding means.

50. The apparatus of claim 46 wherein the lip of the attachment means includes a flat end portion for transferring the counterforce from the attachment means to the bottom surface of the support surface along a line and for reducing the shearing effect of the lip on the support surface.

51. The apparatus of claim 46 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the grasping and holding means.

52. The apparatus of claim 46 wherein the grasping and holding means includes the top surface abutting means which comprises, in combination: a flat, bottom section, with the bottom section of the grasping and holding means extending beyond the attachment means adjacent to the preventing means for abutting with the top surface of the support surface.

53. The apparatus of claim 45 wherein the grasping and holding means comprises a slotted member including an inverted slot for receiving the second end of the flexible pulling member, with the inverted slot being in a spaced relation from the support surface.

54. The apparatus of claim 53 wherein the slotted member is an inverted U-shaped member such that the slot extends in a substantially vertical direction from the removed portion of the U-shaped member.

55. The apparatus of claim 54 wherein the apparatus further comprises at least two side members attached perpendicularly adjacent to the opposite sides of the U-shaped member and parallel to each other for holding and supporting the U-shaped member in a substantially vertical manner.

56. The apparatus of claim 53 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

57. The apparatus of claim 56 wherein the support surface aperture is circular in shape and wherein the attachment means has a circular cross section.

58. The apparatus of claim 56 wherein the preventing means comprises a pin inserted within the support surface aperture next to the attachment means after the attachment means has been moved in the first lateral direction to an extent that the support surface engages the removed portion.

59. The apparatus of claim 56 wherein the attachment means includes an L-shaped member including a vertical leg and a horizontal leg, with the horizontal leg defining the abutting lip, wherein the vertical leg is attached to the bottom surface of the grasping and holding means, and wherein the removed portion is defined between the horizontal leg and the bottom surface of the grasping and holding means.

60. The apparatus of claim 56 wherein the lip of the attachment means includes a flat end portion for transferring the counterforce from the attachment means to the bottom surface of the support surface along a line and for reducing the shearing effect of the lip on the support surface.

61. The apparatus of claim 56 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the grasping and holding means.

62. The apparatus of claim 56 wherein the grasping and holding means includes the top surface abutting means which comprises, in combination: a flat, bottom section, with the bottom section of the grasping and holding means extending beyond the attachment means adjacent to the preventing means for abutting with the top surface of the support surface.

63. Apparatus, for rotation about a vertical axis, for attaching accessories of an apparatus for repairing and straightening to a support surface, for allowing rotational self-alignment of the accessories about the vertical axis, and for allowing the accessories to be substantially in line with the counterforce, where the support surface has a top surface and a bottom surface defining a finite thickness and includes at least one regularly shaped aperture passing vertically through the support surface, comprising, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means form the aperture; and means extending around the preventing means, located on the opposite side of the attachment means from the lip, for abutting with the top surface of the support surface.

64. The apparatus of claim 63 wherein the support surface aperture is circular in shape and wherein the attachment means has a circular cross section.

65. The apparatus of claim 63 wherein the preventing means comprises a pin inserted within the support surface aperture next to the attachment means after the attachment means has been moved in the first lateral direction to an extent that the support surface engages the removed portion.

66. The apparatus of claim 63 wherein the attachment means includes an L-shaped member including a vertical leg and a horizontal leg, with the horizontal leg defining the abutting lip, wherein the vertical leg is attached to the bottom surface of the accessory, and wherein the removed portion is defined between the horizontal leg and the bottom surface of the accessory.

67. The apparatus of claim 63 wherein the lip of the attachment means includes a flat end portion for transferring the counterforce from the attachment means to the bottom surface of the support surface along a line and for reducing the shearing effect of the lip on the support surface.

68. The apparatus of claim 63 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the accessory.

69. The apparatus of claim 68 wherein the accessory includes the top surface abutting means which comprises, in combination: a flat, bottom section, with the bottom section of the accessory extending beyond the attachment means adjacent to the preventing means for abutting with the top surface of the support surface.

70. The apparatus of claim 68 wherein the support surface aperture is circular in shape and wherein the attachment means has a circular cross section.

71. The apparatus of claim 63 wherein the accessory includes the top surface abutting means which comprises, in combination: a flat, bottom section, with the bottom section of the accessory extending beyond the attachment means adjacent to the preventing means for abutting with the top surface of the support surface.

72. Apparatus for anchoring a vehicle to a support surface comprising, in combination: a flexible pulling member including a first end and a second end; means, located on the first end of the pulling member, for attaching the pulling member to the vehicle; a slotted member including an inverted slot for receiving the second end of the flexible pulling member, with the inverted slot being in a vertically spaced relation above the support surface, with the chain being able to be positioned in either a first position or a second position, with the first position allowing the chain to be vertically inserted upward into the inverted slot and with the second end being thrown over the slotted member to prevent the chain from falling from the inverted slot of the slotted member and the second position allowing the chain to be placed over and around the slotted member and then extended into the inverted slot of the slotted member, such that the pulling member lies in a substantially horizontal manner and substantially in line with the counterforce conveyed by the pulling member to substantially reduce the necessity for use of supporting apparatus in straightening the frame of the vehicle; and means for attaching the slotted member to the support surface.

73. The apparatus of claim 72 wherein the slotted member is an inverted U-shaped member such that the slot extends in a substantially vertical direction from the removed portion of the U-shaped member.

74. The apparatus of claim 73 wherein the apparatus further comprises at least two side members attached perpendicularly adjacent to the opposite sides of the U-shaped member and parallel to each other for holding and supporting the U-shaped member in a substantially perpendicular vertical manner.

75. The apparatus of claim 72 wherein the slotted member is substantially vertical.

76. The apparatus of claim 72 wherein the means for attaching the slotted member to the support surface comprises, in combination: means, for rotation about a vertical axis, for attaching the slotted member to the support surface, for allowing rotational self-alignment of the slotted member about the vertical axis, and for allowing the slotted member to be substantially in line with the counterforce.

77. The apparatus of claim 76 wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

78. The apparatus of claim 77 wherein the support surface aperture is circular in shape and wherein the attachment means has a circular cross section.

79. The apparatus of claim 77 wherein the preventing means comprises a pin inserted within the support surface aperture next to the attachment means after the attachment means has been moved in the first lateral direction to an extent that the support surface engages the removed portion.

80. The apparatus of claim 77 wherein the attachment means includes an L-shaped member including a vertical leg and a horizontal leg, with the horizontal leg defining the abutting lip, wherein the vertical leg is attached to the bottom surface of the slotted member, and wherein the removed portion is defined between the horizontal leg and the bottom surface of the slotted member.

81. The apparatus of claim 77 wherein the lip of the attachment means includes a flat end portion for transferring the counterforce from the attachment means to the bottom surface of the support surface along a line and for reducing the shearing effect of the lip on the support surface.

82. The apparatus of claim 77 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the slotted member.

83. The apparatus of claim 82 wherein the slotted member upstands from a flat, bottom section, with the bottom section extending beyond the attachment means adjacent to the preventing means and comprising the top surface abutting means.

84. The apparatus of claim 77 wherein the slotted member upstands from a flat, bottom section, with the bottom section extending beyond the attachment means adjacent to the preventing means and comprising the top surface abutting means.

* * * * *